United States Patent [19]

Kratochvil, Jr.

[11] 4,109,876

[45] Aug. 29, 1978

[54] SUSPENSION MEANS FOR FURNITURE SHIPPING PACKAGE

[75] Inventor: John R. Kratochvil, Jr., Newton, N.C.

[73] Assignee: Boise Cascade Corporation, Boise, Id.

[21] Appl. No.: 704,943

[22] Filed: Jul. 13, 1976

[51] Int. Cl.[2] ..... B65D 85/00

[52] U.S. Cl. ..... 206/326

[58] Field of Search ..... 206/320, 326, 349; 229/34 R, 31 FS, 30

[56] References Cited

U.S. PATENT DOCUMENTS

| | | | |
|---|---|---|---|
| 2,330,262 | 9/1943 | Biggs | 229/31 R |
| 3,823,864 | 7/1974 | Ohkubo | 229/19 |
| 3,917,155 | 11/1975 | Bemiss | 229/30 |

*Primary Examiner*—Herbert F. Ross
*Attorney, Agent, or Firm*—Lawrence E. Laubscher

[57] ABSTRACT

A unitary suspension blank is disclosed for supporting an article of furniture or the like in a shipping container, characterized in that the blank is foldable to a hollow configuration to define a platform upon which the seat frame is supported. Normally the height of the platform is greater than the height of the furniture legs, whereupon the lower extremities of the legs are spaced from the bottom panel of the folded suspension blank. The suspension blank may be mounted within the lower portion of a cover member which is connected with the side walls of the folded suspension blank to form a rugged shipping package in which the legs are fully protected against damage.

2 Claims, 22 Drawing Figures

Fig. 1
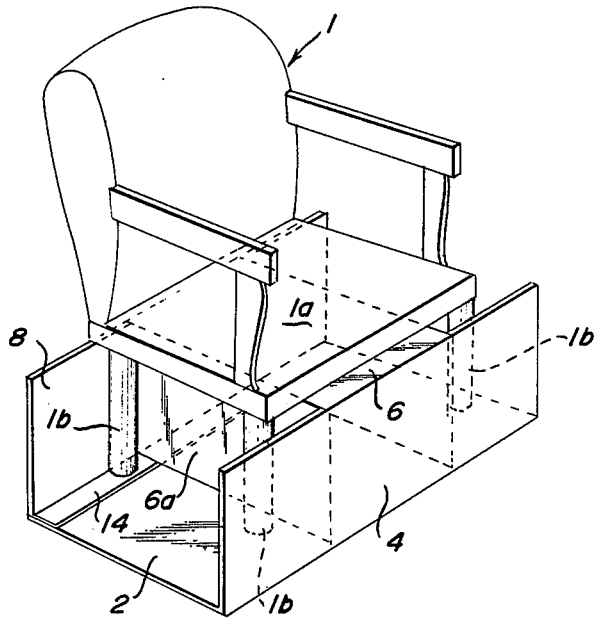
Fig. 2
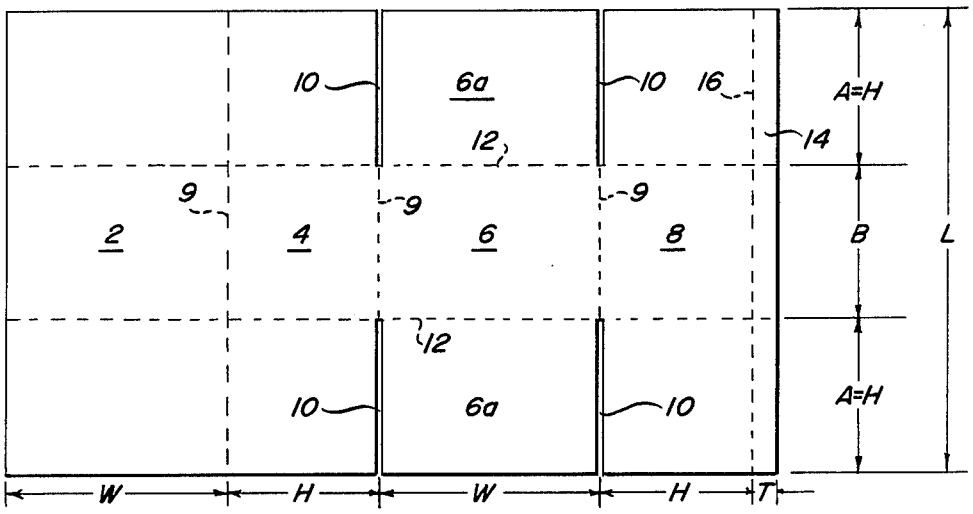
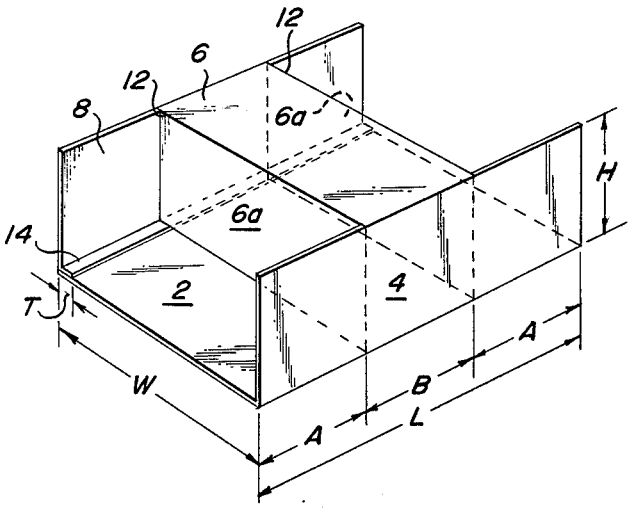
Fig. 3

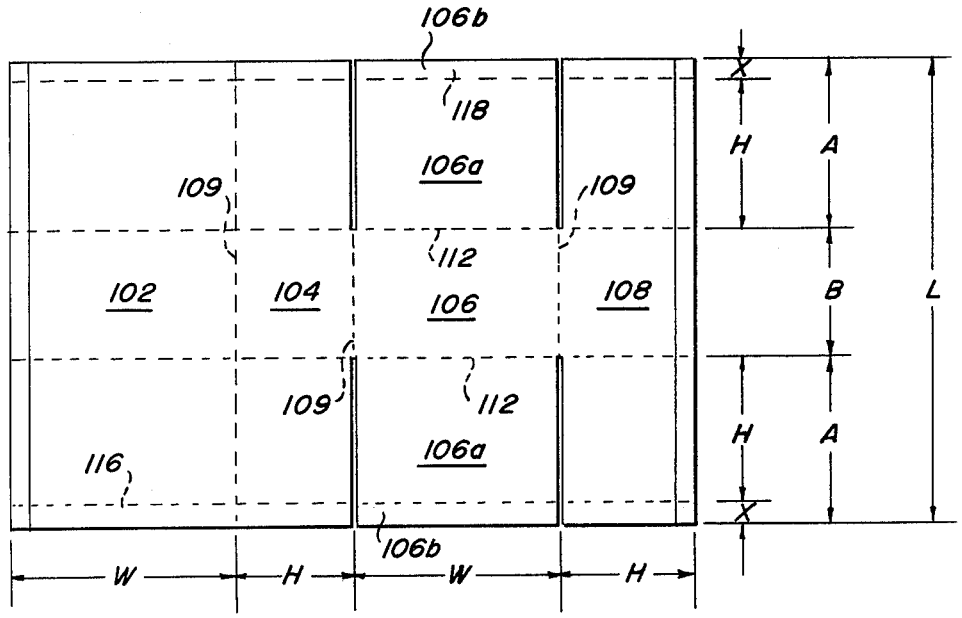
Fig. 4
Fig. 5
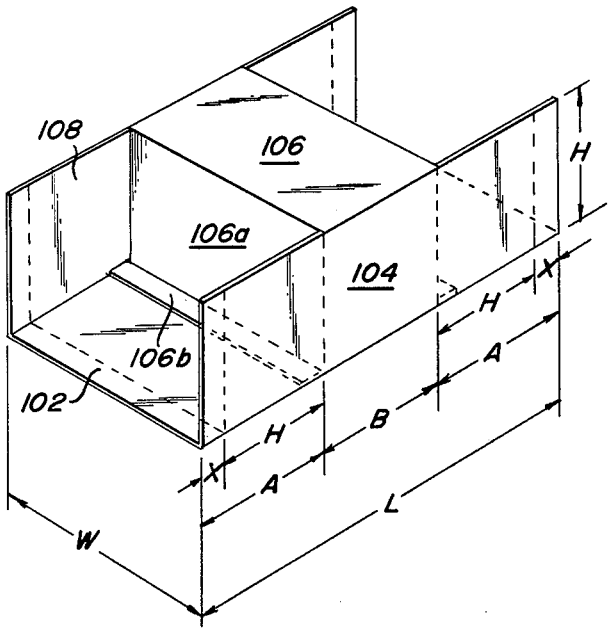

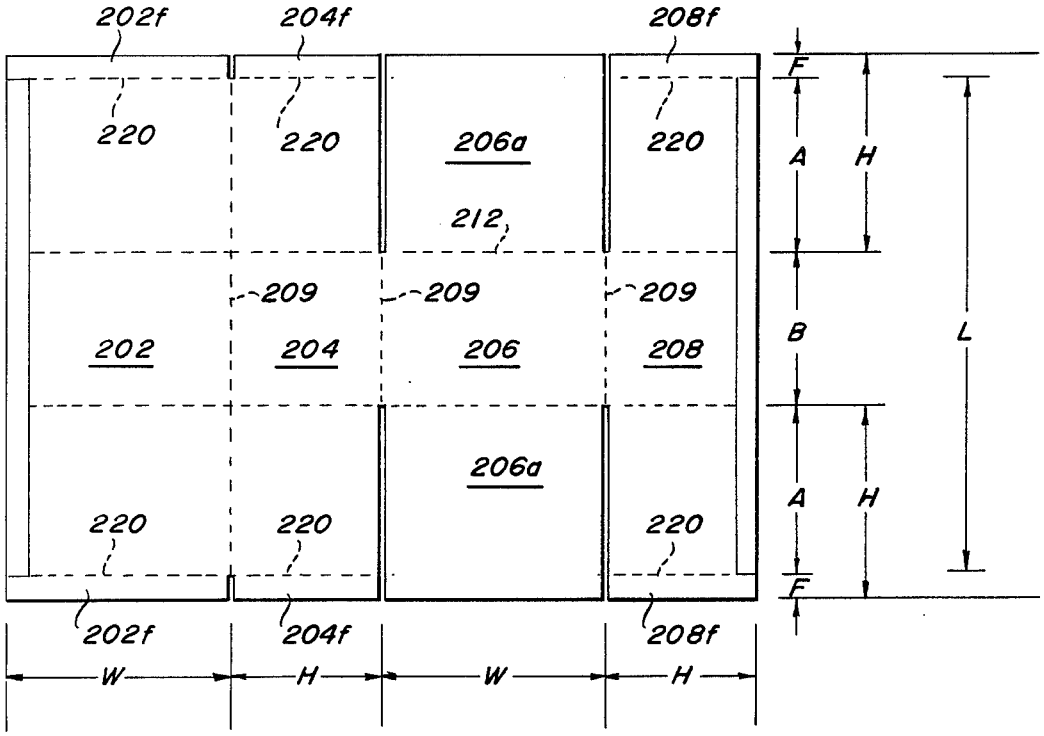
Fig.6
Fig.7
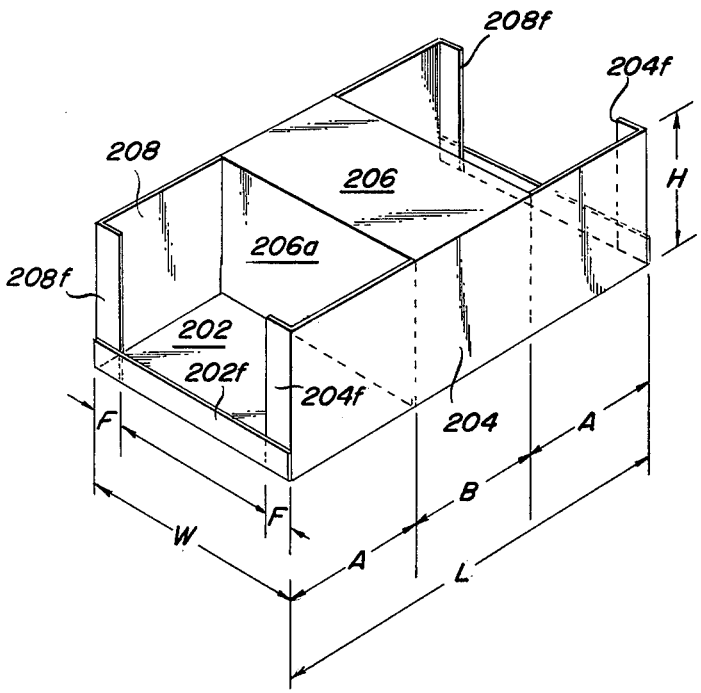

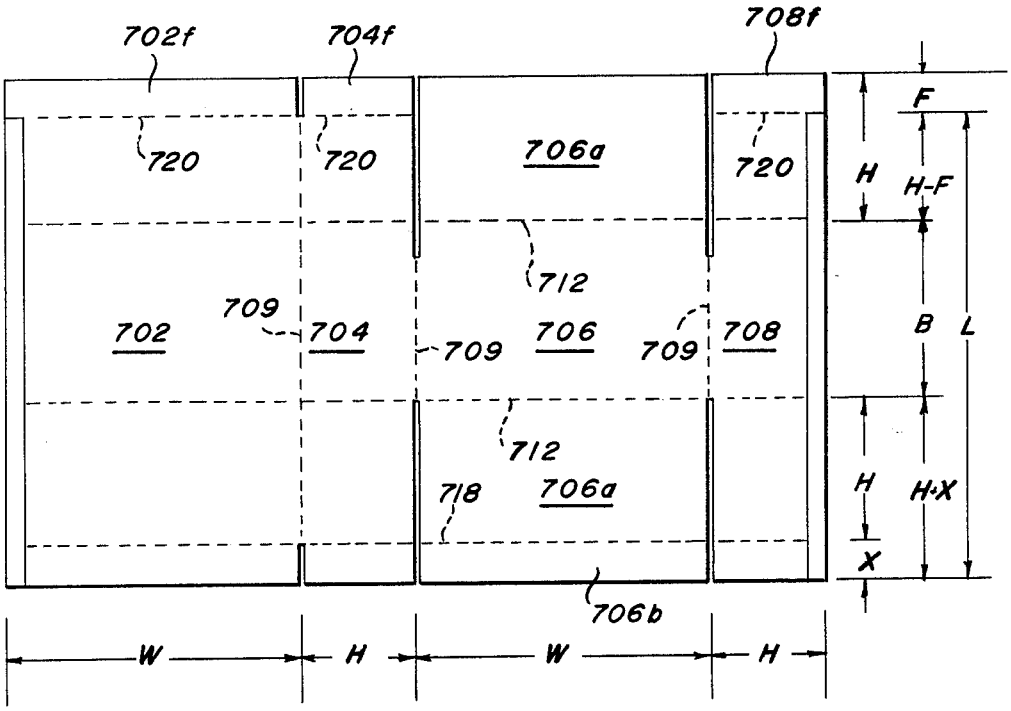
Fig. 14
Fig. 15
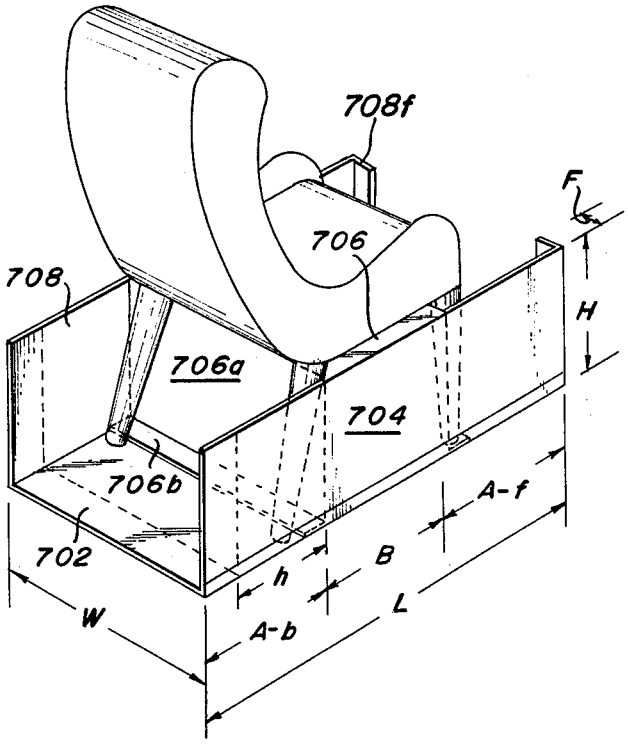

Fig. 16
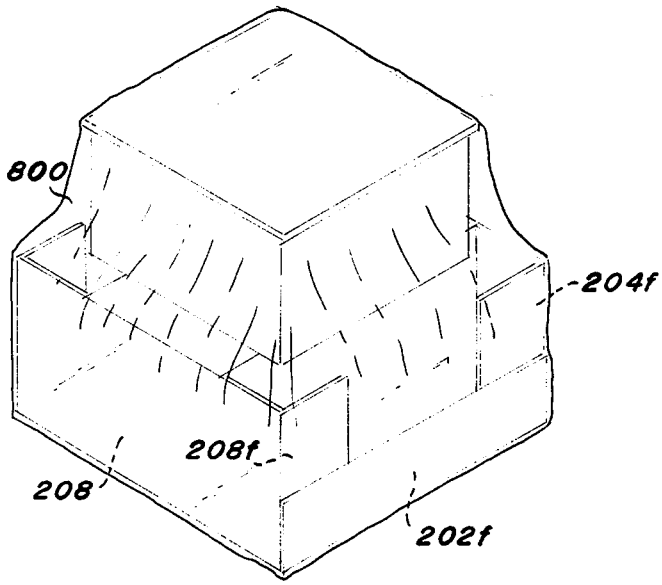
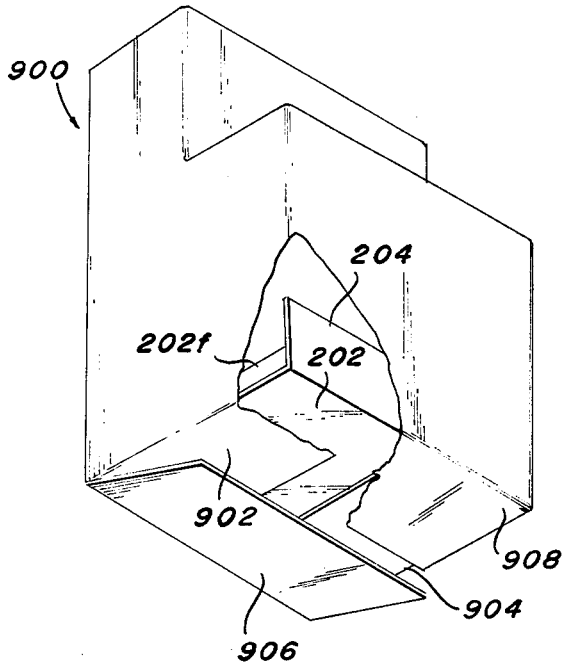
Fig. 17
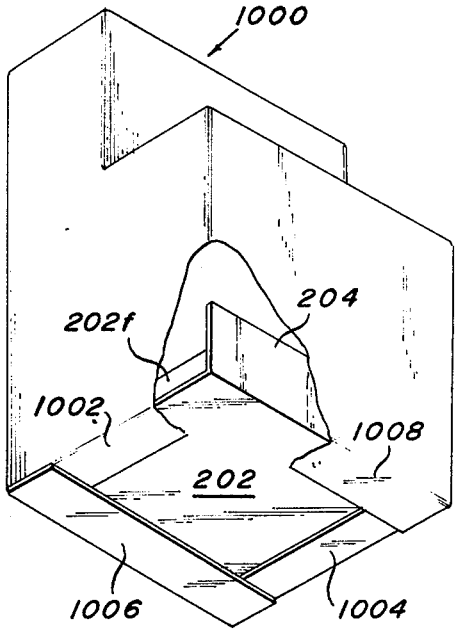
Fig. 18

Fig. 21
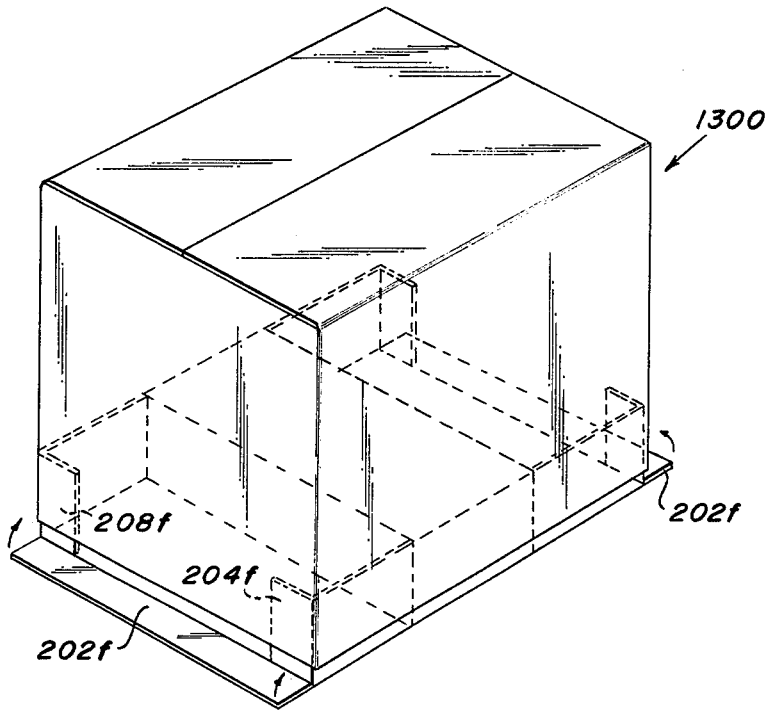
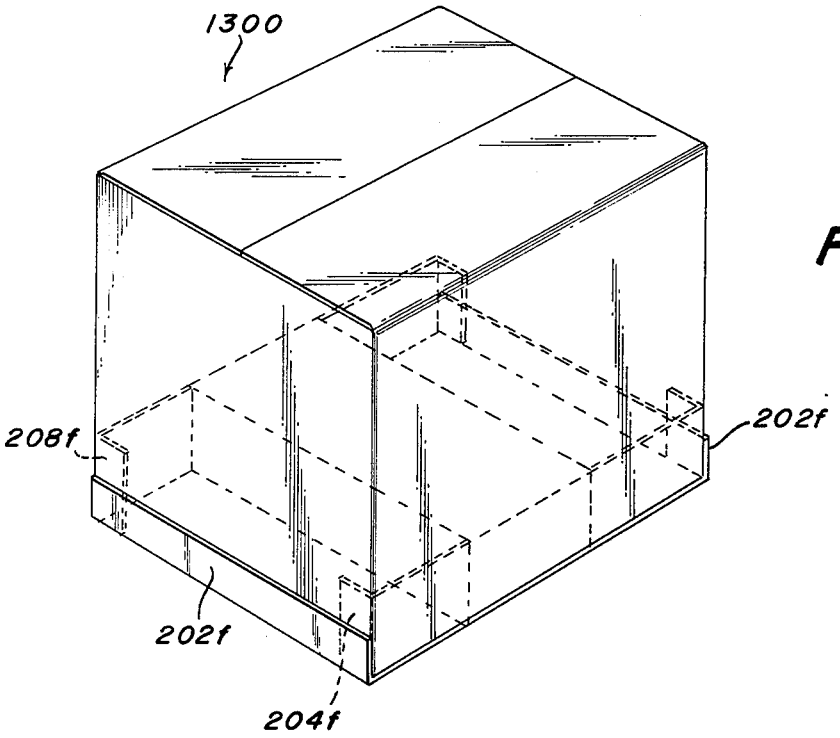
Fig. 22

SUSPENSION MEANS FOR FURNITURE SHIPPING PACKAGE

BRIEF DESCRIPTION OF THE PRIOR ART

Various types of shipping containers for furniture have been proposed in the patented prior art, as evidenced by my prior U.S. Pat. No. 3,934,720, and the U.S. Pat. Nos. to Addison 2,633,982, Riley 2,783,930, Bobb 3,642,127, Wohlers 2,331,753, Bishop 2,346,003 and Miller 3,661,318, among others.

In the handling and packaging of furniture it is desirable to protect the legs of the furniture from breakage caused by a direct impact to the legs.

One of two types of systems are commonly used to protect the legs. In one system the legs rest directly on a platform made of wood or corrugated fiberboard, and in a second system, the piece of furniture is suspended by the frame of the furniture in such a way that the legs will not contact the floor or bottom of the shipping container. Much of the prior art is illustrated in "Furniture Packaging" (1972), an abstract of the "Uniform Freight Classification," and the "National Motor Freight Classification."

SUMMARY OF THE INVENTION

The present invention was developed to provide an improved suspension carton means of unitary construction for supporting an article of furniture against damage in a shipping container.

Accordingly, a primary object of the present invention is to provide a unitary suspension blank formed of fibrous material, such as corrugated paperboard or the like, which is foldable to a hollow configuration including a central platform portion for supporting the seat frame portion of an article of furniture with the legs depending downwardly on opposite sides of the platform. Preferably the height of the platform is greater than the height of the legs of the article, whereupon the lower extremities of the legs are spaced above the bottom panel of the folded suspension blank.

A more specific object of the invention is to provide a suspension blank including successive bottom, first side, top and second side panels foldably connected by parallel first fold lines, the fold lines between the top and side panels containing slots which define top flaps that are foldably connected with the top panel by second fold lines normal to the first fold lines. Consequently, when the panels are folded to define a hollow tube of rectangular cross-sectional configuration, the top flaps may be folded downwardly to vertical positions, thereby to define the seat frame supporting platform. Preferably the dimensions of the top flaps are such that the edges thereof are in frictional snug engagement with the corresponding inner surfaces of the bottom and side panels, respectively.

According to a more specific object of the invention, the lower edges of the top flaps may be provided with foldable support tabs that may be secured, if desired, to the upper surface of the bottom panel to stabilize the top flaps.

According to another object of the invention, a cover member is provided which encloses the article of furniture and at least the upper portion of the folded suspension blank. The cover member may be a shrink-fit cover formed of synthetic plastic material that is fitted about the article of furniture and the folded suspension blank, or a rigid carton formed from corrugated board or the like which contains the article of furniture and the folded suspension blank. In the latter case, the side walls of the cover member are fastened by conventional means with the side panels of the folded suspension blank. In accordance with another object of the invention, the ends of the bottom and side panels of the folded blank may be provided with end tabs which are folded to positions normal to their respective panels for fastening with the opposed end walls of the cover member.

BRIEF DESCRIPTION OF THE DRAWING

Other objects and advantages of the present invention will become more apparent from a study of the following specification when viewed in the light of the accompanying drawing, in which:

FIG. 1 is a perspective view illustrating an article of furniture supported by the folded blank suspension means of the present invention;

FIGS. 2 and 3 are plan and perspective views of the carton blank when in the unfolded and folded conditions, respectively;

FIGS. 4 and 5 are plan and perspective views of a second modification of the carton blank when in the unfolded and folded conditions, respectively;

FIGS. 6 and 7 are plan and perspective views of a third modification of the carton blank when in the unfolded and folded conditions, respectively;

FIG. 14 is a plan view of a further modification of the invention, when in the unfolded condition, and FIG. 15 is a perspective view of an article of furniture supported by the carton blank of FIG. 14 when in the folded condition;

FIG. 16 is a perspective view of a carton assembly including a shrink-fit cover applied to the folded carton blank of FIG. 7; and FIGS. 17–22 illustrate various carton assemblies including a cover member applied to the folded carton blank of FIG. 7.

DETAILED DESCRIPTION

Figure 8:
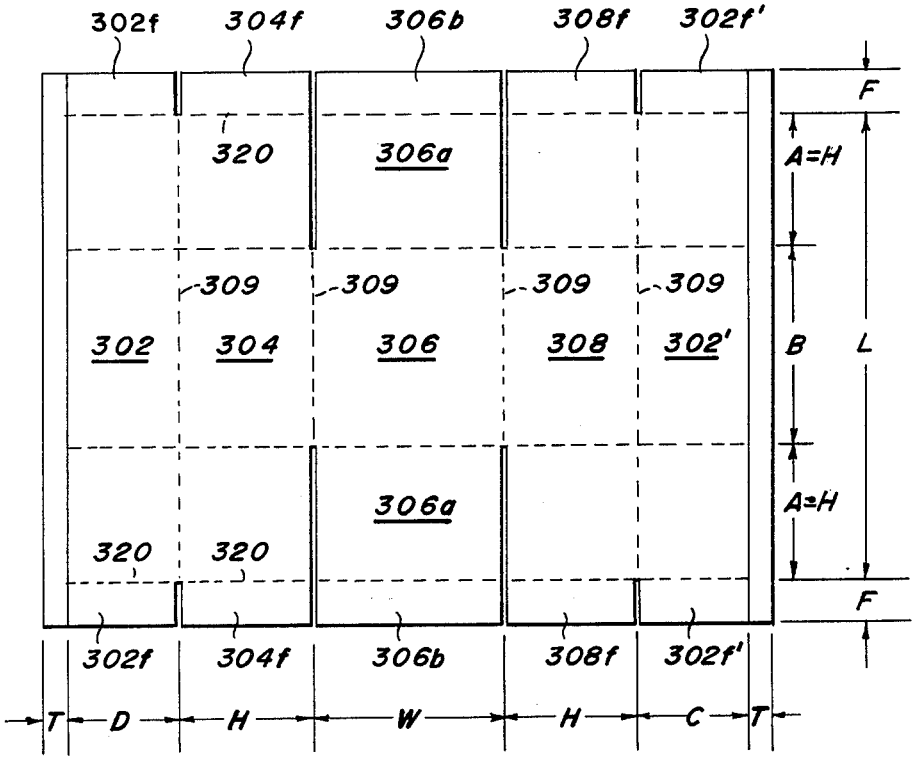
FIGS. 8 and 9 are plan and perspective views of a fourth modification when in the unfolded and folded conditions, respectively.

Referring first more particularly to FIGS. 1–3, the suspension box blank of the present invention is of unitary construction as shown in FIG. 2 and is foldable to the configuration of FIGS. 1 and 3 for supporting an article of furniture 1 having a seat frame portion 1*a* and depending leg portions 1*b*. As shown in FIG. 2, the carton blank includes successive bottom, first side, top and second side panels 2, 4, 6, and 8, respectively, that are foldably connected by first fold lines (9). The fold lines 9 between the top panel 6 and the side panels 4 and 8 contain at each end slots 10 which define top flaps 6*a*foldably connected with the top panel by second fold lines 12 which extend normal to the first fold lines 9. In assembling the blank of FIG. 2, the panels are folded about the first fold lines 9 into a tubular configuration having a rectangular cross section, the free edges of the bottom and second side wall panels 2 and 8 being adjacent each other. In order to secure the panels together, a fastening tab 14 is connected with the free edge of the second side panel 8 by third fold line 16 which is parallel with the first fold lines 9. Consequently, the tab portion 14 is folded to a position normal to the second side wall 8 into engagement with the upper surface of the bottom wall 2 as shown in FIG. 3. The fastening tab 14 is then secured to the bottom wall 2 in a conventional manner, as for example, by adhesive, or by staples. The top flaps 6*a* are then folded downwardly about the second fold lines 12 toward vertical positions contained between the side and bottom panels. Preferably, the dimensions of the panels and the top flaps is such that the free edges of the top flaps are in frictional binding engagement with the corresponding inner surfaces of the side and bottom panels in a snug-fit manner. The article of furniture 1 is then mounted upon the center platform portion of the carton blank defined by the top panel 6 and the top flaps 6*a* as shown in FIG. 1. More particularly, the seat frame portion 1*a* is seated upon the top panel 5, and the leg portions 1*b* extend downwardly on both sides of the platform between the side panels 4 and 8. Preferably, the height (H) of the side panels 4 and 8 and the top flaps 6*a* is slightly greater than the length of the leg portions 1*b* of the article of furniture, whereby the lower extremities of the leg portions 1*b* are spaced from the bottom panel 2. The article of furniture 1 and the folded suspension blank are then contained within a cover member as will be described in greater detail below with reference to FIGS. 16–22.

Referring now to the modification of FIGS. 4 and 5, the top flaps 106*a* are provided with support tabs 106*b* that are foldably connected with the top flaps by fourth fold lines 118 which are parallel with the second fold lines 112. As shown in FIG. 5, these support tabs are folded outwardly normal to the top flaps 106*a* into engagement with the upper surface of the bottom panel 102, and may be secured thereto by conventional means if desired. In this embodiment, the fastening tab 14 of FIG. 2 is omitted, the free adjacent edges of the bottom panel 102 and the second side panel 108 being taped together by a suitable tape connection.

Referring now to the embodiment of FIGS. 6 and 7, the bottom and side panels are provided with end tabs 202*f*, 204*f*, and 208*f* which are foldable about fifth fold lines 220 parallel with the second fold line 212 toward positions normal to their respective panels as shown in FIG. 7. If desired, the end tabs at each end of the folded blank may be connected together by suitable means, such as a layer of adhesive, thereby strengthening the ends of the folded suspension blank.

Figure 9:
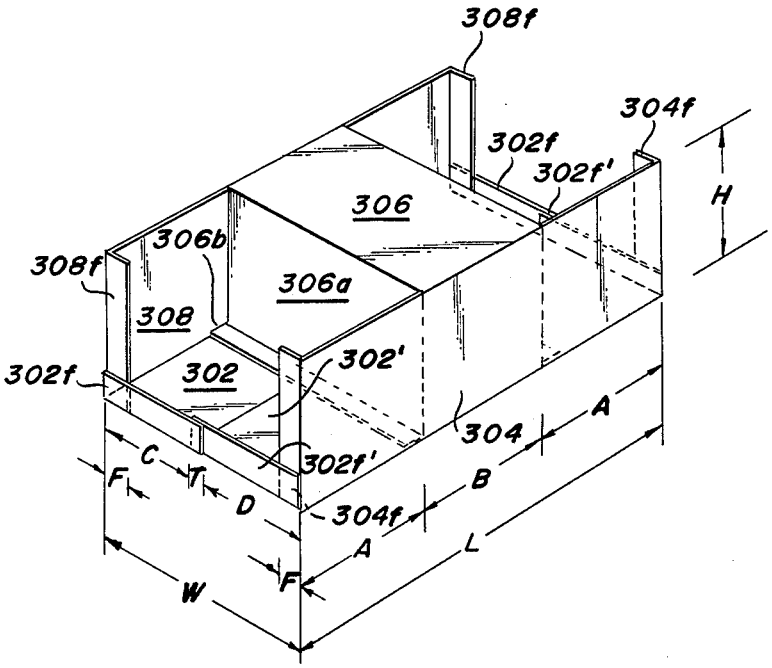

Referring now to the embodiment of FIGS. 8 and 9, the bottom panel consists of two sections 302 and 302' which are connected with the bottom edges of the side panels 304 and 308 by the fold lines 309. The sum of the width of the bottom panel sections is greater than the width (W) of the top wall panel, whereupon the bottom panel sections overlap somewhat when the blank is folded to its folded condition illustrated in FIG. 9. These overlapping portions of the bottom sections may be secured together i.e., by an adhesive layer, or by staples, to form the hollow tubular configuration. In this embodiment, the top wall flaps 306*a* are provided with support tabs 306*b*, and the bottom and side wall panels are provided with the end tabs 302*f*, 302*f'*, 304*f*, and 308*f*. The carton blank is assembled as shown in FIG. 9, the height of the top flap 306*a* being equal to the height (H) of the side panels 304 and 308.

Figure 10:
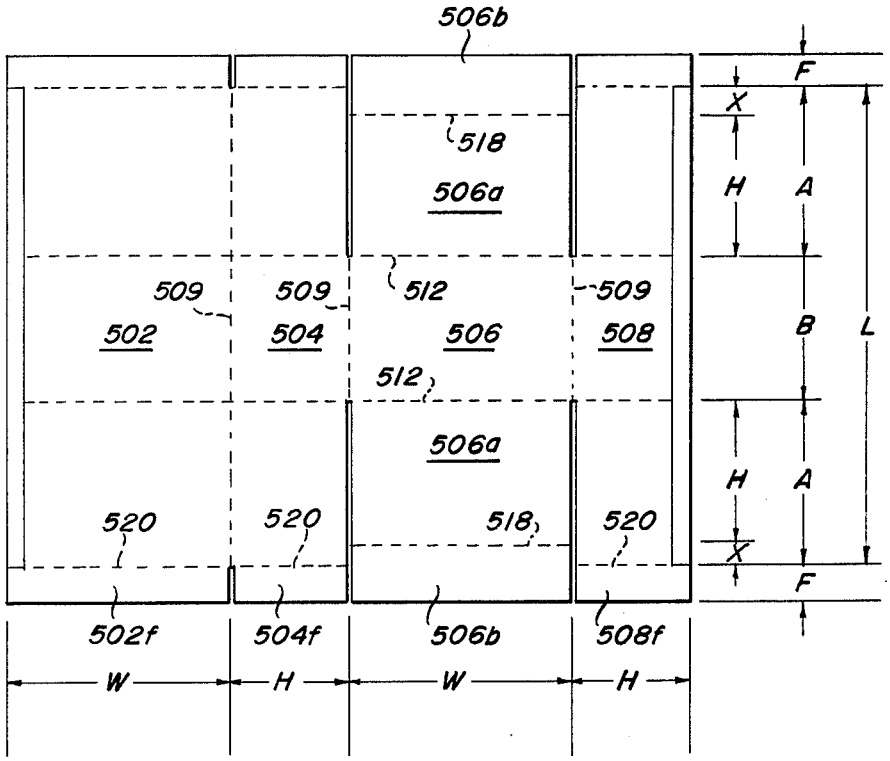
FIGS. 10 and 11 are plan and perspective view of a fifth modification when in the unfolded and folded conditions, respectively.
Figure 11:
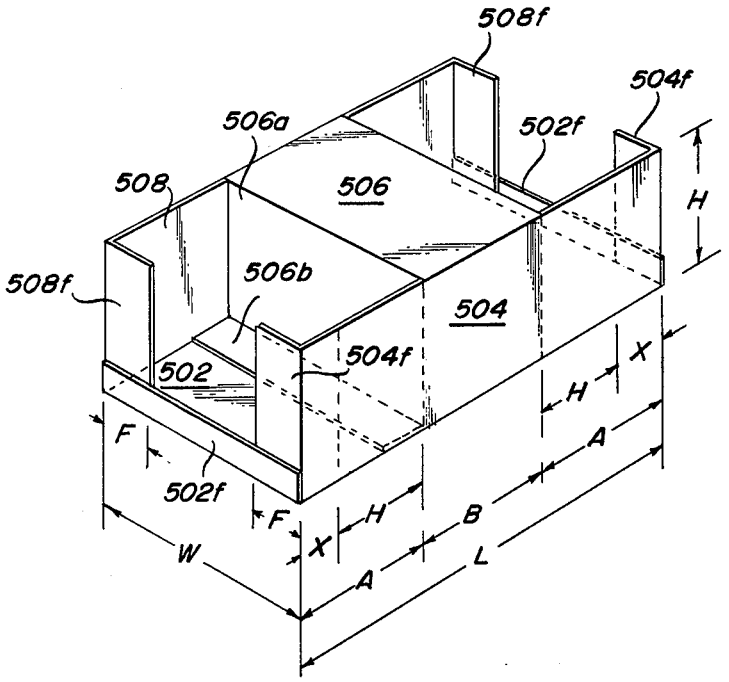

Referring now to the embodiment of FIGS. 10 and 11, the top flaps 506*a* are provided with supporting flaps 506*b* that are foldably connected with the top flap by fold line 518, and the bottom and side panels are provided with end flaps 502*f*, 504*f* and 508*f* that are foldable about fold lines 520. As in the prior embodiments, the height (H) of the top flaps 506*a* equals the height (H) of the side panels 504 and 508. The blank is assembled as described above and as illustrated in FIG. 11.

Figure 12:
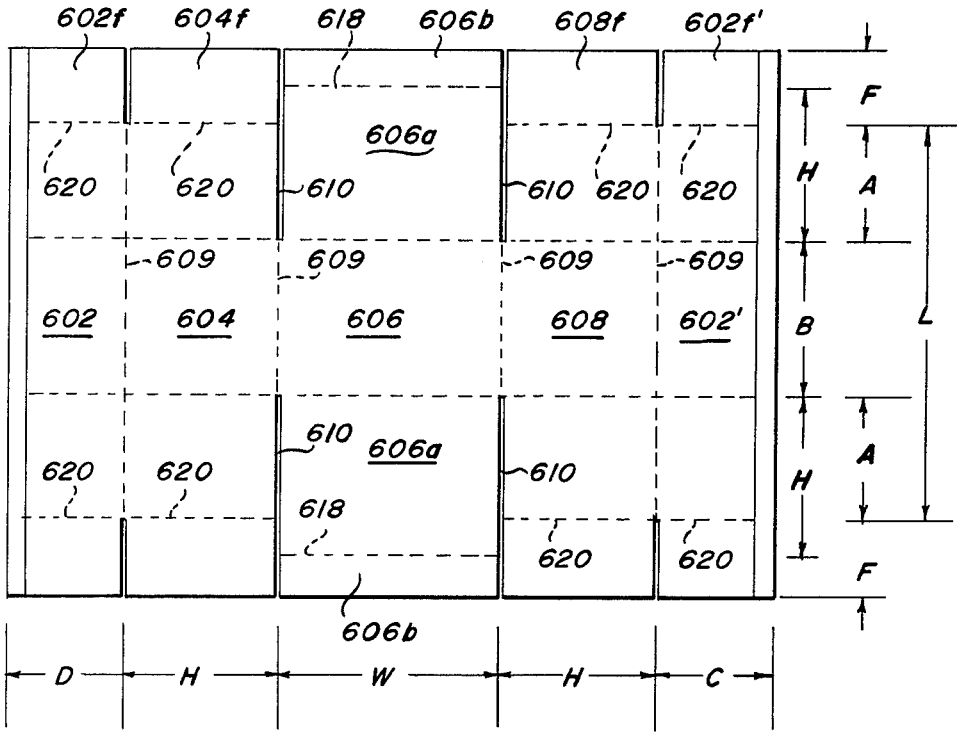
FIGS. 12 and 13 are plan and perspective views of a sixth embodiment of the invention when in the unfolded and folded conditions, respectively.
Figure 13:
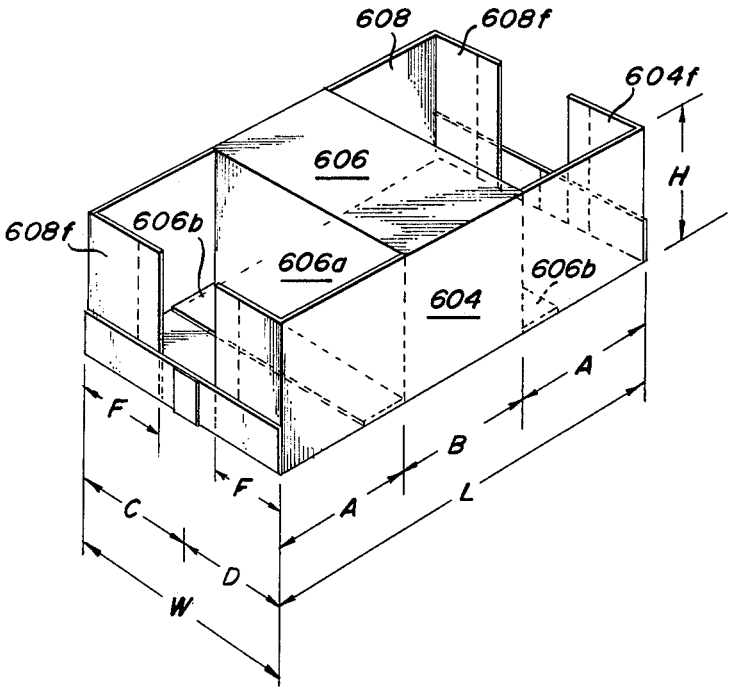

In the embodiment of FIGS. 12 and 13, the top flaps are provided with support tabs 606*b*, and the bottom panel section 602 and 602' and the side panels (604 and 608) are provided with end tabs 602*f*, 602*f'*, 604*f* and 608*f* which are foldable about fold lines 620. The blank is folded as previously described to the folded condition illustrated in FIG. 13.

In each of the previously described suspension carton blank embodiments, the platform portion has been centrally arranged longitudinally of the folded blank. Referring now to the embodiments of FIGS. 14 and 15, the platform portion of the folded blank is longitudinally displaced toward one end of the folded blank. Thus, at one side of the blank one top flap 706*a* is provided with a support tap 706*b* that is foldable about fold line 718, and at the other edge of the blank, the bottom and side panels are provided with end tabs 702*f*, 704*f*, and 708*f* that are foldable about fold lines 720. Consequently, when the blank is folded to the configuration illustrated in FIG. 15, and an article of furniture is mounted thereon with the seat portion of the article supported by the top panel 706, the forward legs of the article are adjacent the end tabs 702*f*, 704*f* and 708*f*, and the rear legs of the article are spaced an appreciable distance from the other end of the folded blank.

After an article of furniture is suspended upon the folded carton blank as described above, a cover member is provided that encloses the article of furniture and at least the upper portion of the folded suspension blank. Referring to FIG. 16, a conventional shrink-fit cover of synthetic plastic material is arranged around the suspension carton and the article of furniture and is shrunk-fit into tight engagement between the components, thereby to provide a rigid assembly.

In the embodiment of FIG. 17, a rigid cover member 900 formed of corrugated board or the like is deposited downwardly about the article of furniture and the folded suspension blank. In this embodiment, the rigid cover member 900 has bottom flaps 902, 904, 906, 908 that are folded to horizontal positions to completely cover the bottom panel of the folded blank, whereby the article of furniture and the folded suspension blank are completely enclosed. In the embodiment of FIG. 18, the cover member 1000 has bottom flaps 1002, 1004, 1006 and 1008 which only partially cover the bottom panel 202 of the folded suspension blank.

Figure 19:
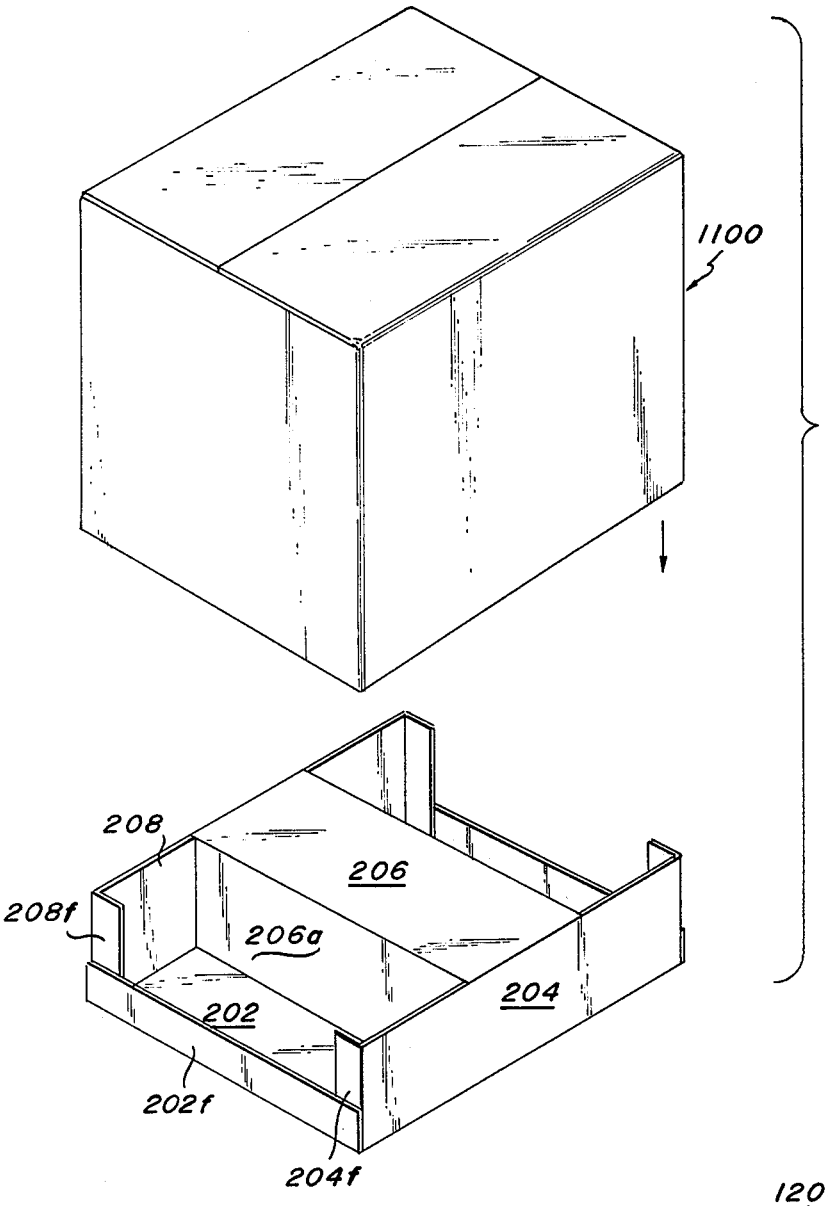
Figure 20:
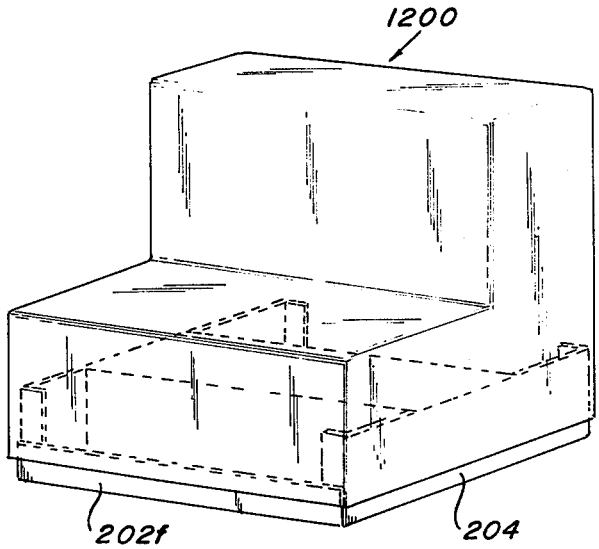

In the embodiments of FIGS. 19 and 20, the cover members are open at their bottom and are fitted downwardly over the article of furniture and the folded suspension blank in a manner similar to that of the aforementioned Kratochvil U.S. Pat. No. 3,934,720. The side walls of the cover member are secured to the outer surfaces of the side panels and end tabs of the folded carton blank in a conventional manner, such as by staples, or layers of adhesive.

In the carton assembly of FIGS. 21 and 22, the end tabs 208*f* and 204*f* are contained within the side walls of the cover member 1300, and the bottom wall tabs 202*f* are folded upwardly into engagement with the outer surfaces of the end walls of the cover member. The tabs and side panels of the folded suspension blank are secured to the cover 1300 by conventional fasting means, such as staples or layers of adhesives.

In accordance with the provisions of the Patent Statutes the preferred forms and embodiments of the invention have been illustrated and described, it will be apparent to those skilled in the art that various changes and modifications may be made in the described cartons and blanks without deviating from the inventive concepts set forth above. What is claimed is:

1. Carton blank means for shipping articles of furniture having frame and depending leg portions, comprising (a) a unitary rectangular blank formed of fibrous material and including successive bottom, first side, top and second side panels foldably connected by parallel first fold lines, respectively;

(b) the first fold lines between said top and side panels having at their free ends slot means which define top flaps foldably connected with said top panel for hinged movement about second fold lines normal to said first fold lines, said side and bottom panels being foldable about said first fold lines to define a hollow tube of rectangular cross-sectional configuration in which the free edges of a pair of said panels are adjacent each other when folded;

(c) means for securing together said free adjacent panel edges, said top flaps being foldable downwardly about said second fold lines toward vertical positions between and normal to said bottom and side panels, respectively, whereby said top panel and top flaps define an erected carton for supporting the article of furniture with the frame portion thereof seated on the top panel and with the leg portions thereof extending in pairs downwardly on opposite sides of the top flaps between said side panels;

(d) the height of each top flap when in the folded vertical position being equal to the height (H) of the side panels, the length of each top flap being equal to the width (W) of the bottom panel (e) supporting tabs foldably connected with the bottom edges of said top flaps by third fold lines parallel with said second fold lines, said supporting flaps being foldable to horizontal positions in contiguous secured engagement with the upper surface of the bottom panel, the height of each top flap being greater than the length of the leg portion of the article of furniture, whereby when the frame portion of the article is seated on the top panel of the erected carton, the lower extremities of the leg portions are spaced from the bottom panel; and (f) end tabs foldably connected with the remaining pairs of opposite edges of said bottom panel and said first and second side wall panels, respectively, by fourth fold lines normal to said first fold lines, respectively, said end tabs being foldable inwardly toward positions normal to their respective panels, the bottom panel end tabs to be secured at opposite ends with the associated side wall end tabs, respectively.

2. Carton blank means as defined in claim 1, wherein said blank further includes an auxiliary bottom panel foldably connected with the edge of said second side wall panel away from said top panel by a further first fold line, the total widths of said bottom and auxiliary bottom panels being slightly greater than the width of the top panel, whereby the edge portions of said bottom and auxiliary bottom panels overlap when said blank is folded to define the hollow tube; and further wherein said securing means is operable to secure together the overlapping portions of said bottom and auxiliary bottom panels.

* * * * *